United States Patent [19]

Barzso

[11] Patent Number: 4,494,452

[45] Date of Patent: Jan. 22, 1985

[54] WINE AERATOR

[76] Inventor: Craig Barzso, 5508 Charlcote Rd., Bethesda, Md. 20817

[21] Appl. No.: 490,507

[22] Filed: May 2, 1983

[51] Int. Cl.[3] ..... B01F 3/04

[52] U.S. Cl. ..... 99/323.1; 261/30; 261/122

[58] Field of Search ..... 99/275, 323.1, 323.2, 99/323.3; 222/401; 261/30, 121, 122, 123, 124; 417/413

[56] References Cited

U.S. PATENT DOCUMENTS

| | | | |
|---|---|---|---|
| 2,790,095 | 4/1957 | Peek | 417/413 |
| 3,309,067 | 3/1967 | Brewster | 261/30 |
| 4,119,244 | 10/1978 | Funke | 222/401 |
| 4,342,710 | 8/1982 | Adolfsson | 99/323.1 |
| 4,395,940 | 8/1983 | Child et al. | 99/323.1 |
| 4,406,591 | 9/1983 | Louis | 417/413 |

*Primary Examiner*—Robert W. Jenkins
*Assistant Examiner*—Arthur D. Dahlberg
*Attorney, Agent, or Firm*—Brady, O'Boyle & Gates

[57] ABSTRACT

An aerator to expedite the breathing time of wine just before serving including a housing containing a motor driven diaphragm air pump; a recess provided in one end of the housing for receiving the neck of a bottle of wine to be aerated, and a tube extending from the pump into the wine within the bottle.

8 Claims, 5 Drawing Figures

FIG. 1
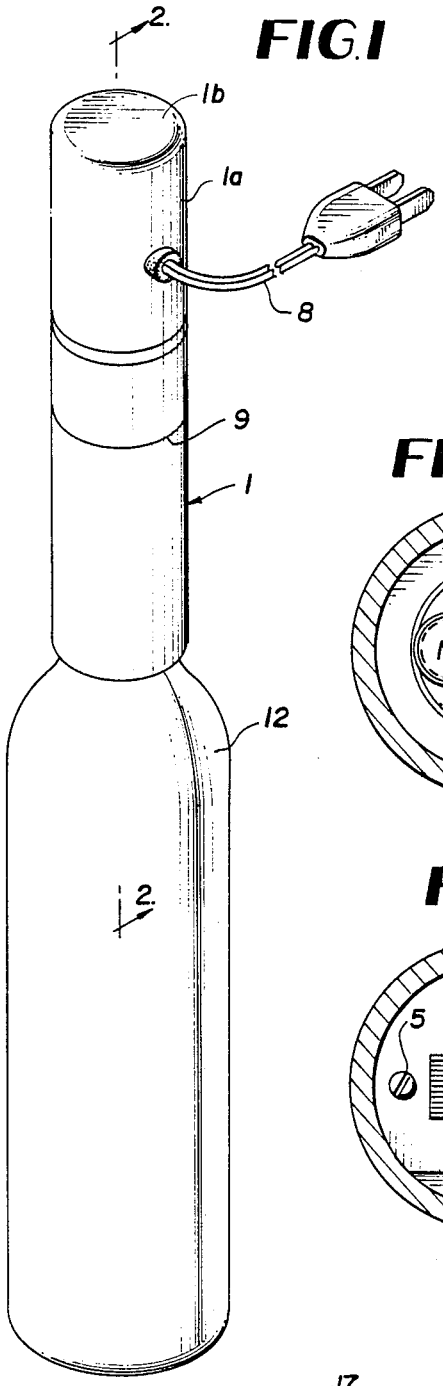
FIG. 2
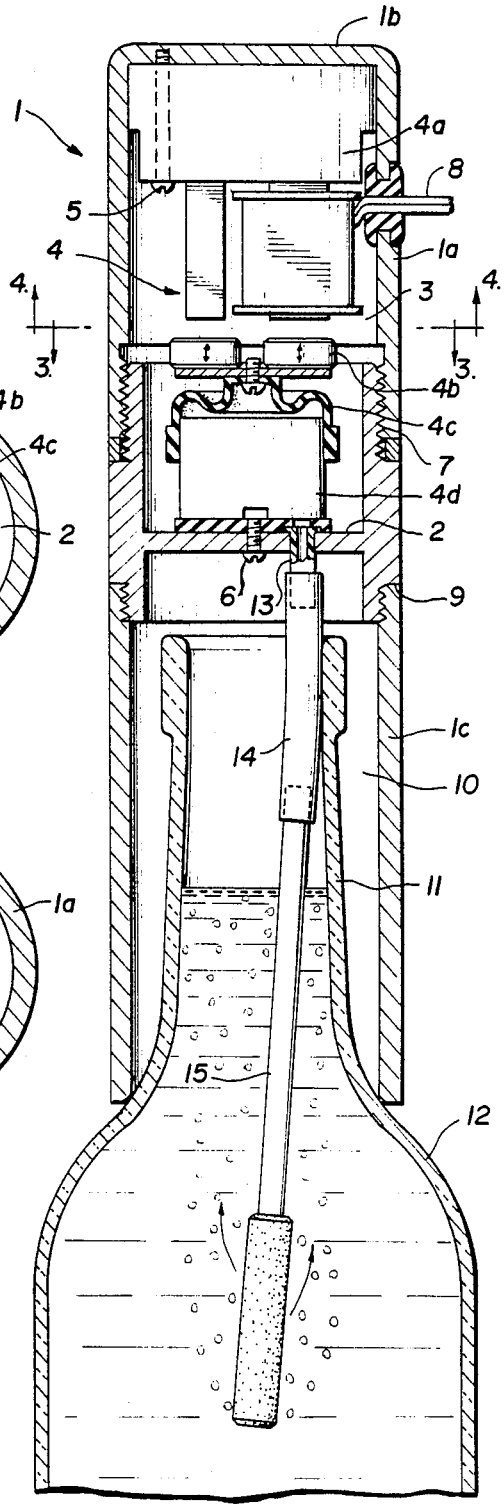
FIG. 3
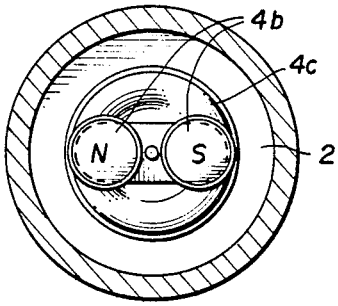
FIG. 4
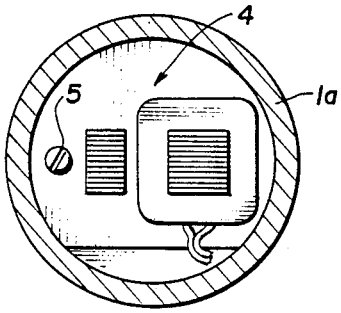
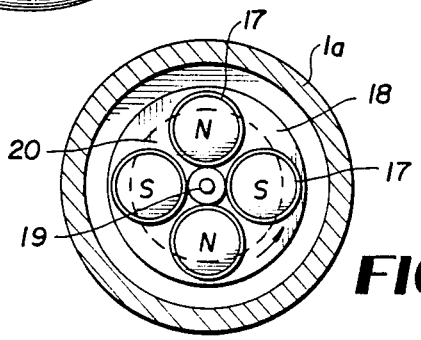
FIG. 5

WINE AERATOR

BACKGROUND OF THE INVENTION

Wine connoisseurs know that to enjoy the bouquet and flavor of a fine wine, the wine should be allowed to breathe. Heretofore, this has been done by merely opening a bottle of wine and allowing it to interact with the atmosphere in order to oxidize certain chemicals, such as tannins, naturally contained in wine, which would otherwise impair the taste of the wine.

In order to expedite the breathing time of wine just before serving, the wine aerator of the present invention has been devised which comprises, essentially, a housing containing a motor driven diaphragm air pump. A recess is provided in one end of the housing adapted to receive the neck of a bottle of wine to be aerated. A tube is connected to the outlet of the air pump and extends into the wine within the bottle just below the wine surface, whereby air from the pump is infused into the wine. The air causes the wine to circulate in the bottle above the bottom thereof, to thereby create an oxygen enriched froth above the wine surface whereby the surface area of the wine is effectively increased without removing the wine from the bottle. By positioning the end of the tube just below the surface of the wine, sediment on the bottom of the bottle is not disturbed during the circulation of the wine.

BRIEF DESCRIPTION OF THE DRAWINGS

FIG. 1 is a perspective view of the wine aerator of the present invention mounted in operative position on a wine bottle;

FIG. 2 is a view taken along line 2—2 of FIG. 1;

FIG. 3 is a view taken along line 3—3 of FIG. 2;

FIG. 4 is a view taken along line 4—4 of FIG. 2; and

FIG. 5 is a bottom plan view of an alternate motor for driving the diaphragm pump.

DESCRIPTION OF THE PREFERRED EMBODIMENT

Referring to the drawings, and more particularly to FIGS. 1 and 2 thereof, the wine aerator of the present invention comprises a cylindrical housing 1 having a partition 2 provided therein to form a chamber 3 defined by the side wall 1*a* of the housing, the end wall 1*b* of the housing and the partition 2. The chamber 3 contains a motor driven diaphragm-air pump assembly 4 comprising an electromagnetic motor 4*a* having an alternating magnetic field which cooperates with magnetic discs 4*b* on the diaphragm 4*c* to impart a reciprocatory movement to the diaphragm, to thereby draw air into and through valves contained within the pump housing 4*d*. This type of motor driven air pump is commonly employed in aquarium-type aerators; therefore, a detailed explanation thereof is deemed unnecessary. The electromagnetic motor 4*a* is secured to he housing end wall by a suitable bolt 5 and the pump housing is secured to the partition 2 by a bolt 6. The wall portion of the chamber 3 containing the electromagnetic motor 4*a* is threadably connected as at 7 to the wall portion of chamber 3 containing the pump, whereby access to the chamber 3 can be obtained to maintain or replace the motorpump assembly.

The lower end of the housing 1 is provided with a tubular extension 1*c* threadably connected as at 9 to the lower end of the housing side wall 1*a*, the extension 1*c* cooperating with the lower surface of partition 2 to form a recess 10 adapted to receive the neck 11 of a bottle of wine 12. By detachably connecting the tubular extension 1*c* to the lower end of housing wall 1*a*, various sized and shaped extensions can be employed to accommodate various sizes and shapes of bottle necks.

To complete the structure of the wine aerator, a nipple 13 communicates with the outlet of the pump housing 4*a* and extends through the partition 2, the free end of the nipple being connected to one end of a flexible plastic tube 14, the opposite end of the flexible tube 14 being connected to a chrome-plated rigid tube 15. The tube 15 extends into the wine within the bottle 12, and a replaceable filter 16 is mounted on the free end of the tube 15.

While an electromagnetic motor of the type having an alternating magnetic field is shown in FIGS. 2 and 4, it is contemplated that a rotary motor having magnetic discs connected to the motor output shaft could also be employed for actuating the diaphragm pump. This embodiment is illustrated in FIG. 5, wherein a plurality of magnetic discs 17 of opposite polarity are arranged alternately on a plastic support disc 18 and secured thereto, the plastic disc being connected to the output shaft 19 of a rotary motor 20. By this construction and arrangement, rotary motor imparted to the alternately polarized magnetic discs 17 on the support disc 18 will cause reciprocatory movement of the magnetic discs 4*b* on the diaphragm 4*c* due to the resultant attraction and repulsion forces between the oppositely facing magnetic discs. The rotary motor can be energized by any A.C. or D.C. power source.

In use, a suitably sized extension 1*c* is connected to the lower end of housing wall 1*a* and the aerator is mounted on the neck 11 of a just opened bottle of wine 12, as shown in FIG. 2, with the lower end of tube 15 immersed into the wine just below the wine surface. The motor pump assembly is then energized to thereby infuse air into the wine whereby the breathing of the wine is expedited, as described.

In marketing the wine aerator of the present invention, it is contemplated that a plurality of various sized extensions 1*c* will be provided to adapt the aerator for use on wine bottles having different sized necks. Also, a chart will be provided to indicate the duration of aerating required for the various types of wine.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A wine aerator for expediting the breathing time of wine just before serving comprising, a housing, a motor driven air pump means mounted in one end of said housing, recess means provided in the opposite end of said housing for freely receiving the neck of a bottle of wine to be aerated, and a tube extending from said air pump means into the wine within the bottle, the free end of said tube being positioned just below the wine surface, whereby air from the pump is infused into the wine, thereby causing the wine to circulate in the bottle above the bottom thereof to create an oxygen enriched froth above the wine surface, whereby the surface area of the wine is effectively increased without removing the wine from the bottle while simultaneously not disturbing the sediment on the bottom of the bottle during the circulation of the wine.

2. A wine aerator according to claim 1, wherein the housing is cylindrical having a wall on one end thereof, and a partition on the opposite end, to thereby form a chamber defined by the housing side wall, end wall and partition, said motor driven pump means being mounted within said chamber.

3. A wine aerator according to claim 2, wherein the recess means comprises a tubular extension detachably connected to the side wall of said cylindrical housing below said partition, said recess being defined by the side wall of said extension and the lower surface of said partition, whereby various sized and shaped extensions can be employed to accommodate various sizes and shapes of bottle necks.

4. A wine aerator according to claim 1, wherein the motor driven pump means includes an electromagnetic motor having an alternating magnetic field, said pump including a diaphragm operatively connected to a valve pump housing, magnetic discs secured to said diaphragm and cooperating with said electromagnetic motor, whereby the alternating magnetic field imparts reciprocatory movement to said diaphragm to thereby draw air into and through the valves contained in said pump housing, said electromagnetic motor being secured to the end wall of said housing, and said pump housing being secured to said partition.

5. A wine aerator according to claim 4, wherein the wall portion of the chamber containing the electromagnetic motor is detachably connected to the wall portion of the chamber containing the pump, whereby access to the chamber can be obtained to maintain or replace the motor and pump.

6. A wine aerator according to claim 4, wherein said tube extends through said partition and said tubular extension.

7. A wine aerator according to claim 1, wherein the motor driven pump means includes a rotary motor, a support disc secured to the output shaft of said motor, a plurality of magnetic discs of opposite polarity arranged alternately and secured to the face of said support disc, said pump including a diaphragm operatively connected to a valve pump housing, magnetic discs secured to said diaphragm and cooperating with the magnetic discs on said support disc, whereby rotary motion imparted to the alternately polarized magnetic discs on said support disc will cause reciprocatory movement of the magnetic discs on the diaphragm to thereby draw air into and through the valves contained in said pump housing.

8. A wine aerator according to claim 1, wherein a filter is connected to the end of the tube extending into the wine.

* * * * *